US009315036B2

(12) United States Patent
Takagi et al.

(10) Patent No.: US 9,315,036 B2
(45) Date of Patent: Apr. 19, 2016

(54) INK CARTRIDGE

(71) Applicant: BROTHER KOGYO KABUSHIKI KAISHA, Nagoya-shi, Aichi-ken (JP)

(72) Inventors: Yuki Takagi, Nagoya (JP); Tomohiro Kanbe, Nagoya (JP); Yasuhiro Kato, Nagoya (JP); Hirotake Nakamura, Nagoya (JP); Hirofumi Kondo, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/741,617

(22) Filed: Jun. 17, 2015

(65) Prior Publication Data

US 2016/0001563 A1 Jan. 7, 2016

Related U.S. Application Data

(63) Continuation of application No. 13/975,248, filed on Aug. 23, 2013, now Pat. No. 9,079,411.

(30) Foreign Application Priority Data

Aug. 24, 2012 (JP) ..... 2012-185494

(51) Int. Cl.
*B41J 2/175* (2006.01)

(52) U.S. Cl.
CPC ..... *B41J 2/17526* (2013.01)

(58) Field of Classification Search
CPC ..... B41J 2/17526
USPC ..... 347/86
See application file for complete search history.

(56) References Cited

U.S. PATENT DOCUMENTS

| | | | |
|---|---|---|---|
| 5,610,635 | A | 3/1997 | Murray et al. |
| 2003/0222940 | A1 | 12/2003 | Seino et al. |
| 2006/0250446 | A1 | 11/2006 | Wanibe et al. |

(Continued)

FOREIGN PATENT DOCUMENTS

| | | | |
|---|---|---|---|
| DE | 20 2009 002 384 | U1 | 7/2009 |
| JP | 2003-341100 | A | 12/2003 |

(Continued)

OTHER PUBLICATIONS

Notice of Reasons for Rejection issued in relate Japanese patent application 2012-185494, mailed Jan. 26, 2016.

*Primary Examiner* — Stephen Meier
*Assistant Examiner* — Alexander D Shenderov
(74) *Attorney, Agent, or Firm* — Merchant & Gould P.C.

(57) ABSTRACT

An ink cartridge comprises a main body comprising a first surface, a second surface, and a chamber, configured to store ink, disposed between the first surface and the second surface; an ink outlet portion disposed on the first surface of the main body configured to direct the ink from the chamber to an exterior of the main body; and an electronic circuit board disposed on the main body. The electronic circuit board comprises an electrical interface, a first portion facing a second direction that intersects a first plane that is perpendicular to the first direction, a second portion facing a third direction away from the ink outlet portion that intersects a second plane that is parallel to the first direction, and a connecting portion between the first portion and the second portion. The electrical interface is disposed on an area of the electronic circuit board including the connecting portion.

20 Claims, 8 Drawing Sheets

(56) References Cited

U.S. PATENT DOCUMENTS

| | | | |
|---|---|---|---|
| 2007/0206076 | A1 | 9/2007 | Seino et al. |
| 2012/0056958 | A1 | 3/2012 | Nozawa et al. |
| 2012/0081481 | A1 | 4/2012 | Gilson et al. |
| 2012/0200646 | A1 | 8/2012 | Karasawa et al. |
| 2012/0212526 | A1 | 8/2012 | Karasawa et al. |
| 2013/0278687 | A1 | 10/2013 | Karasawa et al. |

FOREIGN PATENT DOCUMENTS

| | | | |
|---|---|---|---|
| JP | 2009-132098 | A | 6/2009 |
| JP | 2011-167998 | A | 9/2011 |
| JP | 2012-51315 | A | 3/2012 |
| WO | 2012/086171 | A1 | 6/2012 |

INK CARTRIDGE

CROSS-REFERENCE TO RELATED APPLICATION

This application is a continuation of U.S. patent application Ser. No. 13/975,248, filed Aug. 23, 2013, and further claims priority from Japanese Patent Application No. 2012-185494 filed on Aug. 24, 2012, both of which are incorporated herein by reference in their entirety.

BACKGROUND OF THE INVENTION

1. Field of the Invention

The invention relates generally to an ink cartridge and, more specifically, to an ink cartridge comprising an electronic circuit board with an electrical interface.

2. Description of Related Art

An image recording apparatus records an image on a recording sheet using ink. The image recording apparatus includes an inkjet recording head and selectively ejects ink droplets from nozzles of the recording head onto a recording sheet. The ink droplets land on the recording sheet to record a desired image on the recording sheet. The image recording apparatus includes an ink cartridge storing ink therein to supply ink to the recording head. The ink cartridge may be removably installed in a cartridge mounting portion provided in the image recording apparatus.

The ink cartridge may include an electronic component, e.g., a data storage device, to store data relating to ink color, ink material, a residual amount of ink, and a maintenance condition. The data storage device includes a connection electrode portion. The connection electrode portion is electrically connected with a contact disposed on the cartridge mounting portion when the ink cartridge is installed in the cartridge mounting portion. Data stored in the data storage device may be read via the contact.

A stable electrical connection is required between the connection electrode portion of the data storage device provided in the ink cartridge and the contact of the cartridge mounting portion. If dust adheres to the connection electrode portion or a surface of the connection electrode portion is changed over time to have, for example, an oxide film formed thereon, the stable electrical connection between the connection electrode portion and the contact may not be maintained. Accordingly, reading data from the data storage device may become unstable or impossible.

SUMMARY OF THE INVENTION

The invention may provide an ink cartridge comprising an electrical interface, in which a stable electrical connection may be ensured for the electrical interface.

According to an embodiment of the invention, an ink cartridge comprises a main body comprising a first surface, a second surface, and a chamber configured to store ink and disposed between the first surface and the second surface; an ink outlet portion disposed on the first surface of the main body configured to direct the ink from the chamber to an exterior of the main body; and an electronic circuit board disposed on the main body. The electronic circuit board comprises an electrical interface; a first portion facing a second direction that intersects a first plane that is perpendicular to the first direction; a second portion facing a third direction away from the ink outlet portion that intersects a second plane that is parallel to the first direction; and a connecting portion between the first portion and the second portion, wherein the electrical interface is disposed on an area of the electronic circuit board including the connecting portion.

When the ink cartridge is installed in the cartridge mounting portion, the electrical interface disposed on an area of the electronic circuit board including the connecting portion may be electrically connected with the contact member of the cartridge mounting portion. The electrical interface may be disposed on an area of the electronic circuit board including the connecting portion, so that the electrical interface may slide relative to a contact surface of the contact member. Thus, a surface of the electrical interface may be in a condition suitable for electrical connection.

The electrical interface may be disposed on an area of the electronic circuit board including the connecting portion. Therefore, the electrical interface may reliably be electrically connected with the contact member.

According to an another embodiment of the invention, an ink cartridge comprises a main body comprising a first surface, a second surface, and a chamber configured to store ink and disposed between the first surface and the second surface; an ink outlet portion disposed on the first surface of the main body configured to direct the ink from the chamber to an exterior of the main body in a first direction; and an electronic circuit board disposed on the main body. The electronic circuit board comprises a first portion facing a second direction that intersects a first plane that is perpendicular to the first direction, a second portion protruding from the main body, and an electrical interface. At least a portion of the electrical interface extends between the first portion and the second portion. The electronic circuit board is configured to bend between the first portion and the second portion, such that the second portion faces a third direction away from the ink outlet portion that intersects a second plane that is parallel to the first direction.

Other objects, features, and advantages will be apparent to persons of ordinary skill in the art from the following detailed description of embodiments of the invention and the accompanying drawings.

BRIEF DESCRIPTION OF THE DRAWINGS

For a more complete understanding of the present disclosure, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
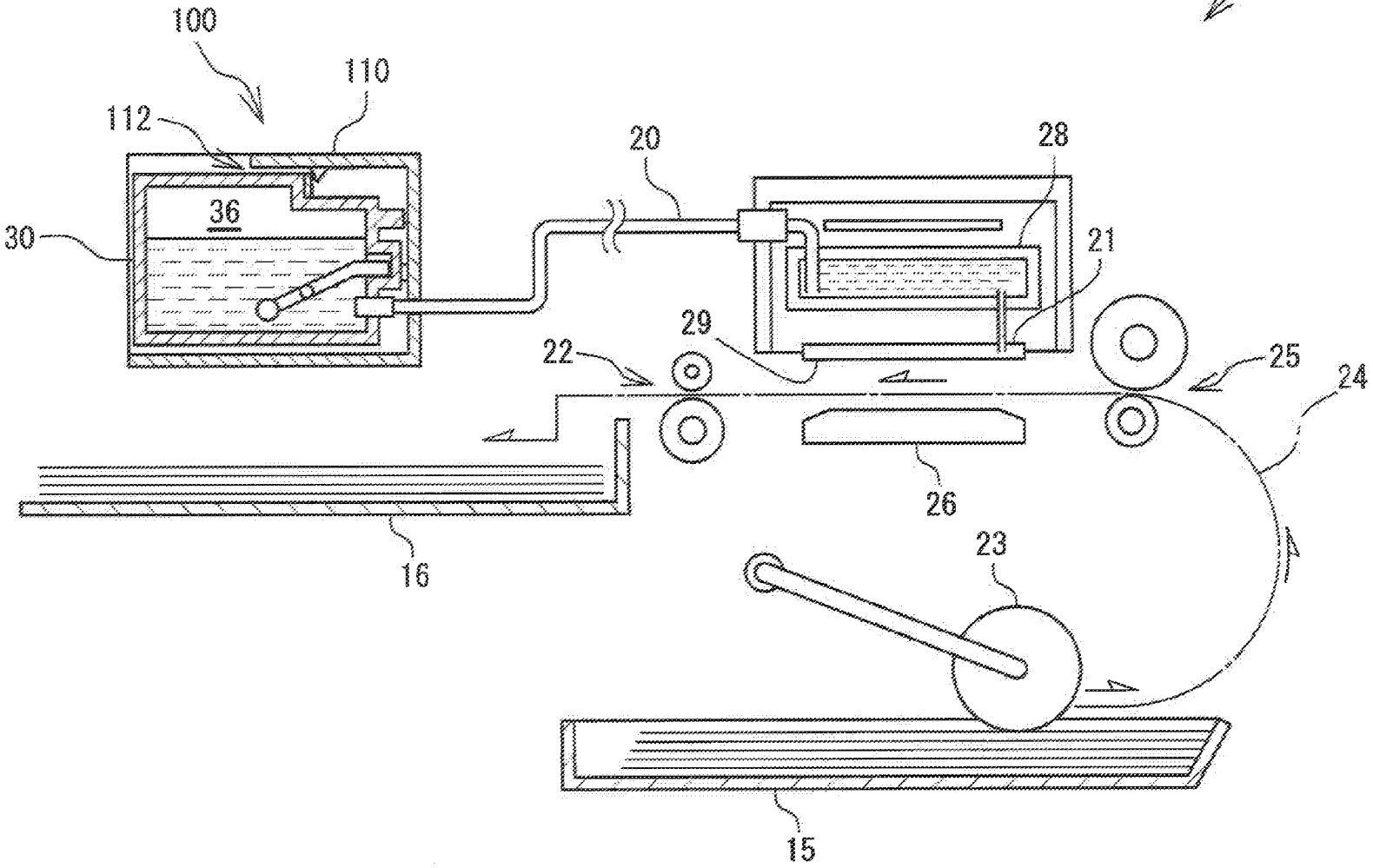
FIG. 1 is a schematic side view of a printer according to an embodiment of the present invention.

Example embodiments are described in detail herein with reference to the accompanying drawings, like reference numerals being used for like corresponding parts in the various drawings.

Referring to FIG. 1, a printer 10, e.g., an inkjet recording apparatus, may be configured to record an image by selectively ejecting ink droplets onto a recording sheet. The printer 10 may comprise a recording head 21 and an ink supply device 100. The ink supply device 100 may comprise a cartridge mounting portion 110. The cartridge mounting portion 110 may be configured to receive an ink cartridge 30. The cartridge mounting portion 110 may have an opening 112 formed therethrough. The ink cartridge 30 may be selectively inserted into or removed from the cartridge mounting portion 110 via the opening 112.

The ink cartridge 30 may be configured to store ink for use in the printer 10. When the ink cartridge 30 is installed in the cartridge mounting portion 110, the ink cartridge 30 may be in fluid communication with the recording head 21 via a flexible tube 20. The flexible tube 20 may be connected to the cartridge mounting portion 110 at one end and to the recording head 21 at the other end. A sub-tank 28 may be positioned in the recording head 21. The sub-tank 28 may be configured to temporarily store ink supplied from the ink cartridge 30 via the flexible tube 20 and to supply ink to nozzles 29 of the recording head 21. The recording head 21 may be configured to selectively eject ink from the nozzles 29.

Recording sheets may be picked up one at a time from a sheet tray 15, by a pick-up roller 23 and conveyed to a conveying path 24. The recording sheet may be conveyed by conveying rollers 25 onto a platen 26. The recording head 21 may selectively eject ink onto the recording sheet conveyed over the platen 26. Thus, an image may be recorded onto the recording sheet. The recording sheet conveyed past the platen 26 may be output by output rollers 22 onto an output tray 16 positioned on the most downstream side of the conveying path 24 in a sheet conveying direction.

Figure 2:
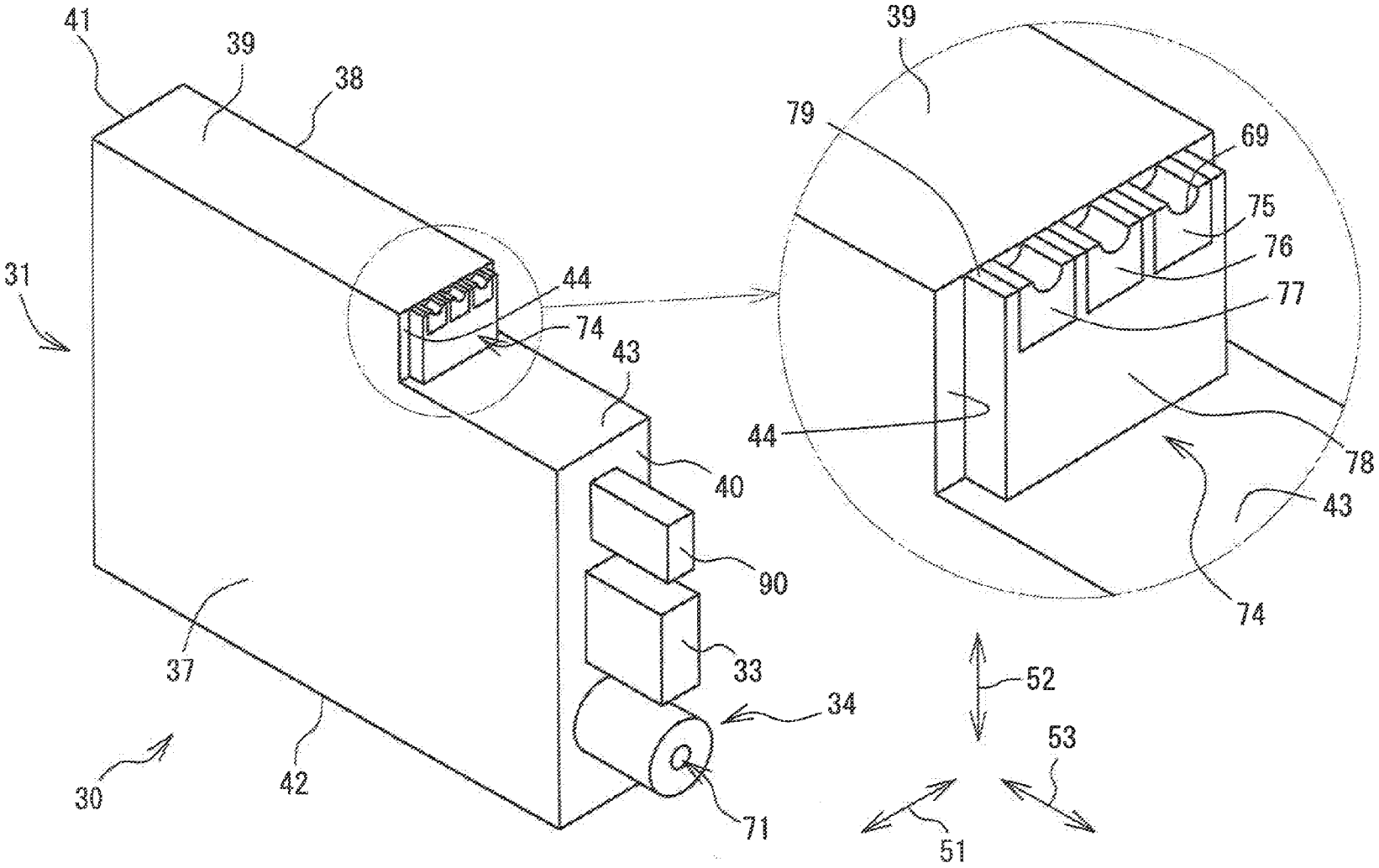
FIG. 2 is a perspective view of an ink cartridge according to an embodiment of the present invention.
Figure 3:
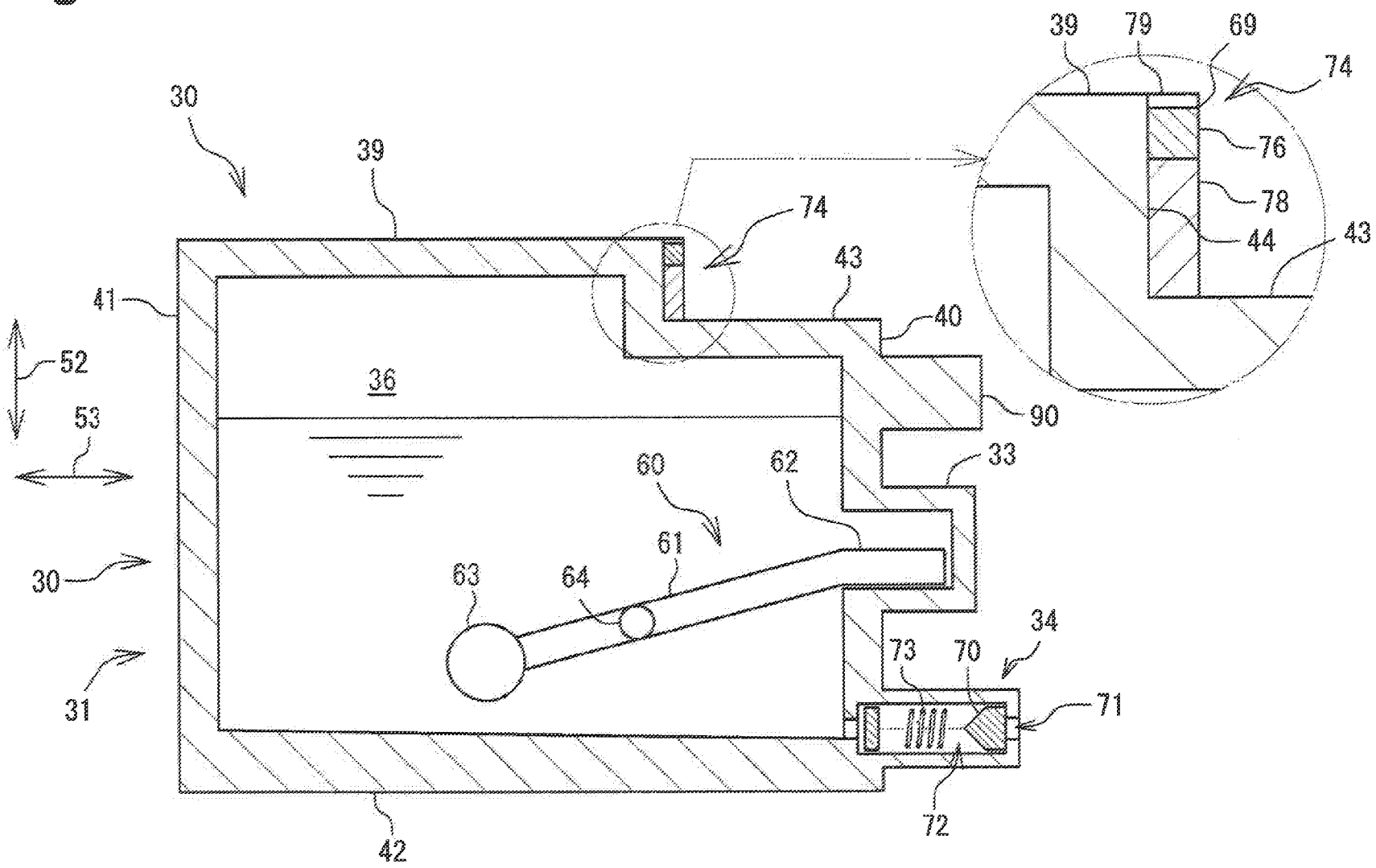
FIG. 3 is a cross-sectional view of the ink cartridge of FIG. 2, according to an embodiment of the present invention.
Figure 4:
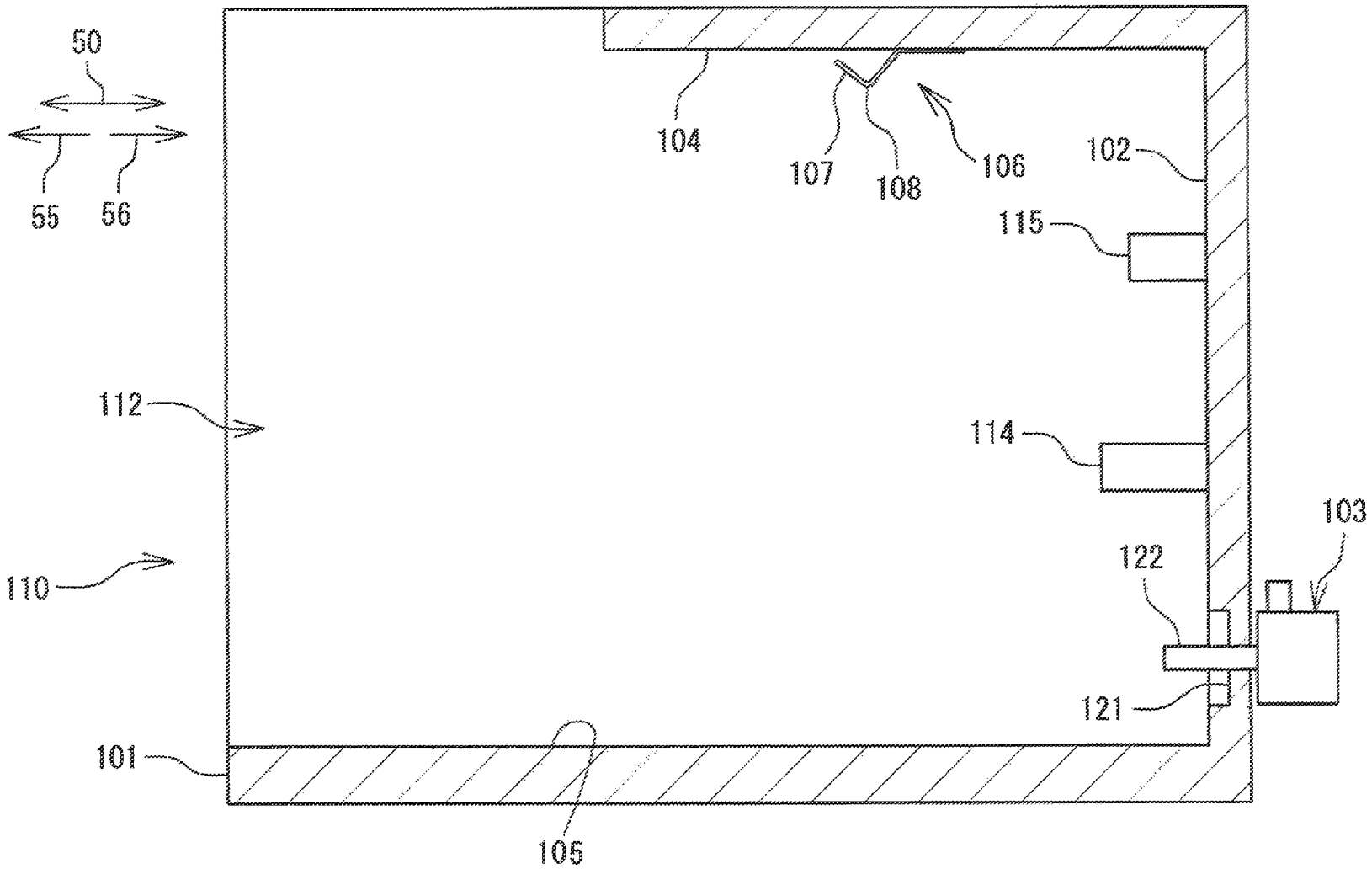
FIG. 4 is a cross-sectional view of a cartridge mounting portion according to an embodiment of the present invention.

Referring to FIGS. 2-4, the ink cartridge 30 may be inserted into and removed from the cartridge mounting portion 110 in an insertion/removal direction 50, e.g., a substantially horizontal direction. More specifically, the ink cartridge 30 may be inserted into the cartridge mounting portion 110 in an insertion direction 56 and removed from the cartridge mounting portion 110 in a removal direction 55.

Referring to FIGS. 2 and 3, the ink cartridge 30 may comprise a container configured to store ink therein. The ink cartridge 30 may comprise a main body 31 comprising an ink chamber 36 within the main body 31. The ink chamber 36 may be configured to store ink therein. In another embodiment, the ink chamber 36 may be defined by a member other than the main body 31.

The main body 31 may have a depth in a depth direction 53, e.g., parallel to the insertion/removal direction 50; a width in a width direction 51; and a height in a height direction 52. The width may be less than each of the height and the depth. The height direction 52, e.g., a vertical direction, may be parallel to a direction of gravity.

The main body 31 may comprise a front wall 40 and a rear wall 41 positioned opposite the front wall 40 in the insertion/removal direction 50. In other words, the front wall 40 may face a first direction in the depth direction 53 and the rear wall 41 may be a distance away from the front wall 40 along the depth direction 53. When the ink cartridge 30 is inserted into the cartridge mounting portion 110, the front wall 40 may face forward in the insertion direction 56 and the rear wall 41 may face rearward in the insertion direction 56. The front wall 40 and the rear wall 41 may extend in the height direction 52. The ink cartridge 30 also may comprise upper walls 39 and 43 and a bottom wall 42 opposite the upper walls 39 and 43 in the height direction 52. The upper walls 39 and 43 and the bottom wall 42 may extend in the depth direction 53, e.g., a front-rear direction, substantially perpendicular to the front wall 40 and the rear wall 41. The upper wall 39 may be connected to the upper end of the rear wall 41 at an end and extend toward the front wall 40 along the insertion/removal direction 50. The upper wall 43 may extend from the upper end of the front wall 40 toward the rear wall 41 along the insertion/removal direction 50. The upper wall 43 may be positioned on a side of the bottom wall 42 with respect to the upper wall 39, e.g., the upper wall 43 may be positioned lower than the upper wall 39 in the height direction 52 to form a step. The bottom wall 42 may be connected to the lower end of the front wall 40 at one end and connected to the lower end of the rear wall 41 at the other end. The ink cartridge 30 may further comprise a front wall 44 connecting a front end of the upper wall 39 and the rear end of the upper wall 43. The front wall 44 may face forward in the insertion direction 56 when the ink cartridge 30 is inserted into the cartridge mounting portion 110. The front wall 44 may be substantially parallel to the front wall 40 and substantially perpendicular to the upper walls 39 and 43. The ink cartridge 30 may further comprise side walls 37 and 38 that may be separated from each other in the width direction 51, e.g., a lateral direction, and may connect to ends of the upper walls 39 and 43, the front walls 40 and 44, the rear wall 41 and the bottom wall 42. An exterior surface of the front wall 40 may correspond to a first surface. An exterior surface of the rear wall 41 may correspond to a second surface. The first surface may face the insertion direction 56 when the ink cartridge 30 is installed in the cartridge mounting portion 110. The second surface may face the removal direction 55 when the ink cartridge 30 is installed in the cartridge mounting portion 110.

In an example embodiment, a front face of the ink cartridge 30 defined by an exterior face of the front wall 40 may be substantially perpendicular to the insertion direction 56 of the ink cartridge 30. In a case where the front wall 40 may be an uneven surface having projections that project along the insertion/removal direction 50 or depressions that are formed to extend along the insertion/removal direction 50, and may have a plurality of faces, a front face of the ink cartridge 30 may be defined by an exterior face of the front wall 40 that faces forward in the insertion/removal direction 50, e.g., in the insertion direction 56, as the first surface. In another embodiment, a front face of the ink cartridge 30 defined by an exterior face of the front wall 40, e.g., the first surface, may extend from the upper wall 39 to the bottom wall 42 as one flat surface. In a case where the rear wall 41 may be an uneven surface having projections that project along the insertion/removal direction 50 or depressions that are formed to extend along the insertion/removal direction 50, and may have a plurality of faces, a rear face of the ink cartridge 30 may be defined by an exterior face of the rear wall 41 that faces rearward in the insertion/removal direction 50, e.g., in the removal direction 55, as the second surface.

The ink cartridge 30 may be inserted into and removed from the cartridge mounting portion 110 in the insertion/removal direction 50, in an orientation depicted in FIGS. 2 and 3, e.g., with the upper walls 39 and 43 thereof facing upward and the bottom wall 42 thereof facing downward. In another embodiment, the ink cartridge 30 may be inserted into and removed from the cartridge mounting portion 110 along the direction of gravity or a direction substantially perpendicular to the horizontal direction and the direction of gravity. For example, when the ink cartridge 30 is inserted into and removed from the cartridge mounting portion 110 along the direction of gravity, the front walls 40 and 44 of the ink cartridge 30 may face downward.

Referring to FIGS. 2 and 3, the main body 31 may comprise a residual ink indicator 33 positioned at a middle portion of the front wall 40 of the main body 31 in the height direction 52. The residual ink indicator 33 may have an open-box shape with an open end. The residual ink indicator 33 may be configured to be in fluid communication with the ink chamber 36 via the open end. The residual ink indicator 33 may comprise a left wall and a right wall each comprising translucent resin configured to allow light to pass therethrough. The light, e.g., infrared light, may be emitted in a direction perpendicular to the insertion/removal direction 50, e.g., the width direction 51, from an optical sensor 114, as shown in FIG. 4, that may be positioned at the cartridge mounting portion 110. The residual ink indicator 33 may further comprise translucent front, upper, and bottom walls. The walls of the residual ink indicator 33 may be configured to allow light to pass therethrough in the width direction 51. In another embodiment, the light emitted from the optical sensor 114 may be visible light. A space between the pair of the left and right walls of the residual ink indicator 33 may be hollow to store ink therein.

Referring to FIG. 3, the residual ink indicator 33 may comprise a sensor arm 60 that may comprise a plate-shaped arm body 61, a plate-shaped indicator portion 62 disposed at an end of the arm body 61, and a float portion 63 disposed at the other end of the arm body 61. The indicator portion 62 may be located between the left and right walls of the residual ink indicator 33. The sensor arm 60 may be configured to pivot and to be supported by a support shaft 64 extending in the width direction 51 in the ink chamber 36. The sensor arm 60 may be configured to pivot in accordance with an amount of ink in the ink chamber 36. The indicator portion 62 may move between a lower position, in which the indicator portion 62 is located at the lower position in the direction of gravity in the residual ink indicator 33, and an upper position, in which the indicator portion 62 is located at the upper position in the direction of gravity in the residual ink indicator 33, according to the residual amount of ink in the ink chamber 36. More specifically, when an amount of ink in the ink chamber 36 is equal to or greater than a predetermined amount, the indicator portion 62 may be placed in the lower position. When ink is used and an amount of ink in the ink chamber 36 is less than the predetermined amount, the indicator portion 62 may be placed in the upper position. FIG. 3 depicts a state in which a predetermined amount or more of ink may be present, such that the indicator portion 62 may be placed in the lower position.

When the ink cartridge 30 is installed in the cartridge mounting portion 110, the residual ink indicator 33 may allow a predetermined amount or more of the infrared light emitted from the optical sensor 114 to pass through in a direction perpendicular to the insertion/removal direction 50, e.g., the width direction 51, or may block or attenuate the light to an amount less than the predetermined amount, depending on the amount of ink stored in ink chamber 36. When the indicator portion 62 is in the upper position, the residual ink indicator 33 may allow the light to pass therethrough. When the indicator portion 62 is in the lower position, the residual ink indicator 33 may block or attenuate the light. Based on whether the residual ink indicator 33 allows the light to pass therethrough or blocks or attenuates the light, it may be determined whether the residual ink amount in ink chamber 36 is greater than or less than the predetermined amount.

The main body 31 may comprise an ink outlet portion 34 positioned at a lower portion of the front wall 40 of the main body 31, below the residual ink indicator 33. The ink outlet portion 34 may be disposed on the first surface, such that the ink outlet portion 34 may be adjacent to the first surface. The ink outlet portion 34 may have a cylindrical shape and may protrude outward from the front wall 40 in the insertion/removal direction 50. The ink outlet portion 34 may be protruded from the exterior of the surface of the front wall 40 along the depth direction 53. The projecting end of the ink outlet portion 34 may be provided with an ink outlet port 71. The insertion direction 56 may correspond to a direction in which the ink outlet portion 34 may protrude.

Referring to FIG. 3, the ink outlet portion 34 may have an ink channel 72 formed therein. The ink channel 72 may extend along the depth direction 53 from the ink outlet port 71 to the ink chamber 36 via an internal space of the ink outlet portion 34. An ink outlet valve 70 may be disposed in the ink channel 72 and configured to selectively open and close the ink outlet port 71. The ink outlet valve 70 may be urged toward the ink outlet port 71 by a coil spring 73 or other urging member disposed in the internal space of the ink outlet portion 34. When the ink cartridge 30 is installed in the cartridge mounting portion 110, a hollow tube 122, as depicted in FIG. 4, provided in the cartridge mounting portion 110 may enter the ink outlet port 71 to open the ink outlet valve 70 against the urging force of the coil spring 73. Thus, ink may be directed from the ink chamber 36 into the hollow tube 122 provided in the cartridge mounting portion 110, through the ink channel 72. Ink may be directed from the ink outlet port 71 to an exterior of the ink cartridge 30 along the insertion direction 56, which may correspond to a first direction, through a center of the ink outlet port 71.

In another embodiment, the ink outlet port 71 may be sealed with a film. When the ink cartridge 30 is installed in the cartridge mounting portion 110, the hollow tube 122 may penetrate the film to open the ink outlet port 71. In another embodiment, the main body 31 may have an air communication opening to bring negative pressure in the ink chamber 36 to the atmospheric pressure.

An electronic circuit board 74 may be disposed on an exterior surface of the main body 31, e.g., an exterior surface of the front wall 44. While the ink cartridge 30 is being installed in the cartridge mounting portion 110, and when the ink cartridge is installed on the cartridge mounting portion 110, the electronic circuit board 74 may contact and be electrically connected with a contact member 106, as depicted in FIG. 4, disposed on the cartridge mounting portion 110.

The electronic circuit board 74 may comprise an integrated circuit ("IC") comprising a memory, a HOT electrode 75, a ground ("GND") electrode 76, and a signal electrode 77. The IC may be a semiconductor integrated circuit. The memory may be configured to store data on the ink cartridge 30, e.g., a manufacturer and ink color. The data stored in the IC may be read out by the printer 10. The HOT electrode 75, the GND electrode 76, and the signal electrode 77 may correspond to an electrical interface.

The HOT electrode 75, the GND electrode 76, and the signal electrode 77 may be electrically connected with the IC. The HOT electrode 75, the GND electrode 76, and the signal electrode 77 may extend vertically along the height direction 52 and may be separated from each other in the width direction 51.

The electronic circuit board 74 may have a thin plate shape formed of a resin plate. With the electronic circuit board 74 attached to the main body 31, the length of the electronic circuit board 74 in the depth direction 53 may be less than each of the lengths in the height direction 52 and the width direction 51. The electronic circuit board 74 may comprise a front surface 78 facing the insertion direction 56 and extending along the width direction 51 and the height direction 52, a surface opposite to the front surface 78 that is configured to contact the front wall 44 of the ink cartridge 30 when the electronic circuit board 74 is attached to the main body 31, and four connecting surfaces connecting the front surface 78 and the surface opposite to the front surface 78. A thickness of the electronic circuit board 74 may be defined by the connecting surfaces. One of the two opposing connecting surfaces in the height direction 52 may be an upper surface 79 comprising: a flat plane facing in the same direction as the upper wall 43. e.g., facing upward in the height direction 52 when the electronic circuit board 74 is attached to the main body 31; and a curved plane defined by the HOT electrode 75, the GND electrode 76, and the signal electrode 77. A ridge 69 may be disposed at a boundary between the front surface 78 and the upper surface 79 at an upper, front end of the electronic circuit board 74. The ridge 69 is an example of a connecting portion, according to an embodiment of the invention. The HOT electrode 75, the GND electrode 76, and the signal electrode 77 may be disposed on an area of the electronic circuit board including the ridge 69 of the electronic circuit board 74. For example, the area may be formed by the ridge 69, a portion of the front surface 78, and a portion of the upper surface around the HOT electrode 75, the GND electrode 76, and the signal electrode 77. The ridge 69 may comprise straight portions and curved portions and may extend along the width direction 51. The straight portions of the ridge 69 may be defined by the resin plate. The curved portions of the ridge 69 may be defined by the HOT electrode 75, the GND electrode 76, and the signal electrode 77. The HOT electrode 75, the GND electrode 76, and the signal electrode 77 may be exposed on the front surface 78 and the upper surface 79 of the electronic circuit board 74, so as to allow electrical access thereto. The front surface 78 may correspond to a first portion. The upper surface 79 may correspond to a second portion. In another embodiment, the ridge 69 may comprise only a straight portion along the width direction 51. The first portion may face a second direction that intersects a first plane that is perpendicular to the first direction (e.g., the insertion direction). The second portion may face a third direction away from the ink outlet portion that intersects a second plane that is parallel to the first direction. In another embodiment, the electrical interface may comprise a curved portion at a boundary between the front surface 78 and the upper surface 79 instead of the ridge 69. In other words, a connecting portion of the electronic circuit board 74 connecting the front surface 78 and the upper surface 79, including the electrical interface, may be curved.

A plurality of the electronic circuit boards 74 may be formed of a resin plate. Openings may be formed through the resin plate in its thickness direction, e.g., a direction parallel to the smallest dimension among the dimensions of the resin plate. An electrical conducting material, e.g., copper, which may be a material used for the HOT electrode 75, the GND electrode 76, and the signal electrode 77, may be poured into the openings. Therefore, the electrical interface may be formed on the surface of the openings. The resin plate may be cut along the thickness direction at positions where the electrical conducting material is present, thereby making a cut surface, which may become the upper surface 79. Thus, the HOT electrode 75, the GND electrode 76, and the signal electrode 77 may be exposed continuously at the front surface 78 and the cut surface of the electronic circuit board 74. Portions of the cut surface at which the electrical conducting material is present may be cut out such that those portions may become lower than the cut surface of the resin plate in the height direction 52. Thus, a portion of each of the HOT electrode 75, the GND electrode 76, and the signal electrode 77 may have a concave shape, at the ridge 69, curving inward (e.g., downward) at the upper surface 79. Each of the HOT electrode 75, the GND electrode 76, and the signal electrode 77 exposed at the front surface 78 and the upper surface 79 of the electronic circuit board 74 may allow electrical access from front and upper sides of the main body 31 in an orientation depicted in FIGS. 2 and 3.

Referring to FIGS. 2 and 3, the main body 31 may comprise a light attenuating portion 90 positioned at an upper portion of the front wall 40 of the main body 31. The light attenuating portion 90 may be disposed above the residual ink indicator 33 in the front wall 40 and below the electronic circuit board 74 in the front wall 44. The light attenuating portion 90 may be a plate-like member protruding from the exterior of the surface of the front wall 40 in the insertion direction 56. The light attenuating portion 90 may be farther from the rear wall 41 of the ink cartridge 30 in the first direction than the front wall 44 is from the second surface in the first direction. The front wall 44 may be farther from the ink outlet port 71 in the third direction than the light attenuating portion 90 is from the ink outlet portion in the third direction. The light attenuating portion 90 may block or attenuate light from an exterior of the ink cartridge 30. The light attenuating portion 90 may block or attenuate light emitted from a light-emitting element toward a light-receiving element of an optical sensor 115 provided in the cartridge mounting portion 110, as depicted in FIG. 4. When the ink cartridge 30 is installed on the cartridge mounting portion 110, the signals output by the optical sensor 115 may change, so that it may be determined that the ink cartridge 30 is installed on the cartridge mounting portion 110.

Referring to FIG. 1, the printer 10 may comprise the recording head 21 and the ink supply device 100 configured to supply ink to the recording head 21. The ink supply device 100 may comprise the cartridge mounting portion 110 configured to receive the ink cartridge 30. In FIG. 1, the ink cartridge 30 may be installed in the cartridge mounting portion 110.

Referring to FIG. 4, the cartridge mounting portion 110 may comprise a case 101 serving as a housing. The case 101 may have the opening 112 on a front side of the printer 10. The ink cartridge 30 may be selectively inserted into and removed from the case 101 via the opening 112. The case 101 may be configured to accommodate a plurality of, e.g., four, ink cartridges 30. Each ink cartridge 30 may correspond to one of a plurality of colors, e.g., cyan, magenta, yellow, and black. FIG. 4 depicts a space of the case 101 in which one ink cartridge 30 may be accommodated.

Referring to FIG. 4, the case 101 may have a rear interior surface 102 at a side opposite from the opening 112 in the insertion/removal direction 50, an upper interior surface 104 that may be connected to an upper end of the rear interior surface 102 in the height direction 52, and a bottom interior surface 105 at a side opposite from the upper interior surface 104 in the height direction 52. A connecting portion 103 may be disposed at a lower portion of the rear interior surface 102 in correspondence with each ink outlet portion 34 of the ink cartridges 30 when the ink cartridges 30 are installed in the case 101.

The connecting portion 103 may comprise the hollow tube 122 and a holding portion 121. The hollow tube 122 may comprise resin and have a tubular shape. An end of the hollow tube 122 may have an ink introduction port. The hollow tube 122 may be connected to the ink tube 20 at an exterior surface opposite from the rear interior surface 102 of the case 101. Each ink tube 20 connected to each hollow tube 122 at the exterior surface opposite from the rear interior surface 102 may be connected to the recording head 21 of the printer 10 so as to circulate the ink.

Figure 5:
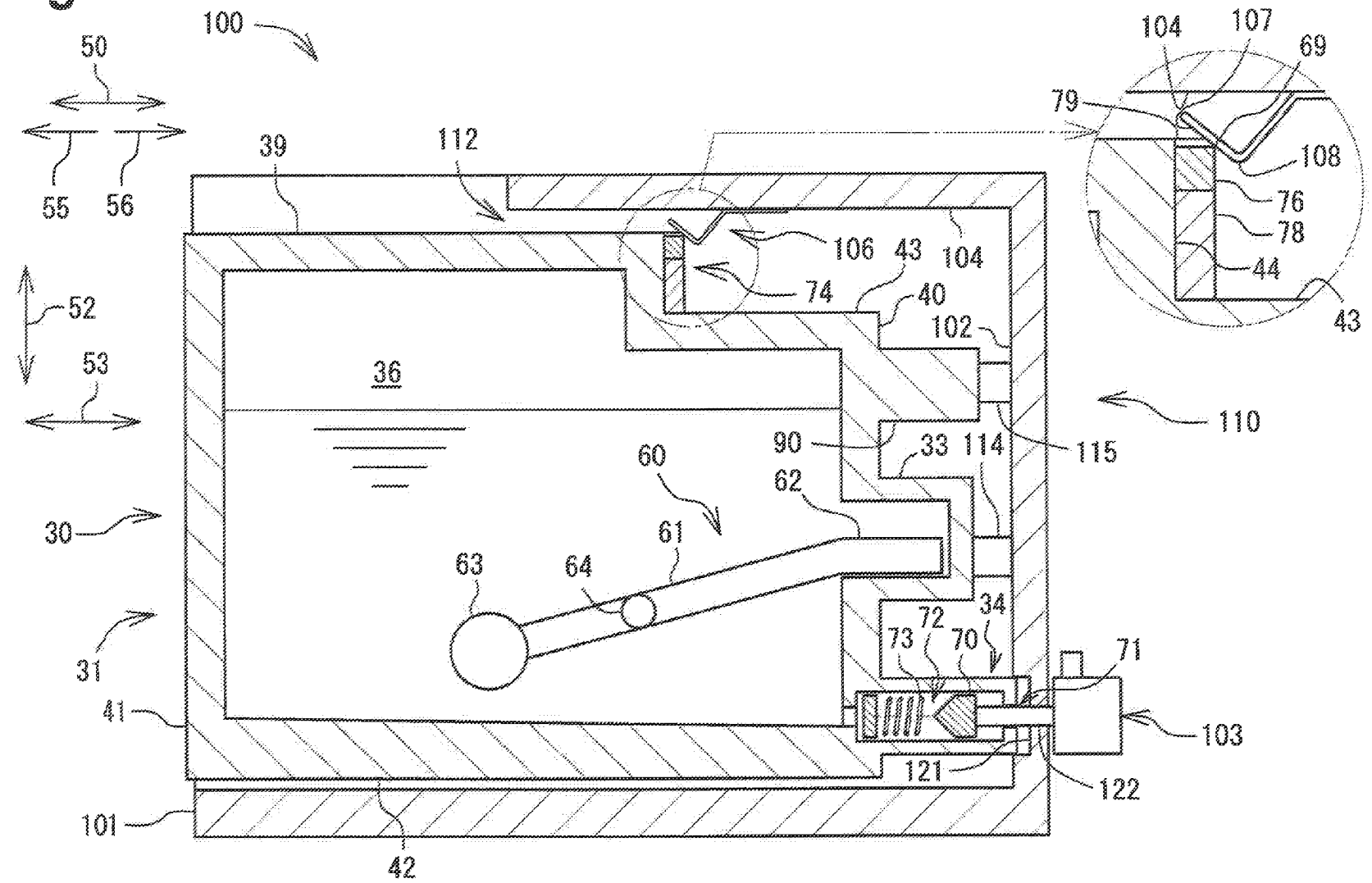
FIG. 5 is a cross-sectional view of the ink cartridge being installed in the cartridge mounting portion according to an embodiment of the present invention.

The holding portion 121 may have a cylindrical shape. The hollow tube 122 may be disposed at a middle portion of the holding portion 121. Referring to FIG. 5, when the ink cartridge 30 is installed in the cartridge mounting portion 110, the ink outlet portion 34 may be inserted into the cylindrical portion of the holding portion 121. The outer peripheral surface of the ink outlet portion 34 may contact the inner peripheral surface of the cylindrical portion of the holding portion 121. When the ink outlet portion 34 is inserted into the holding portion 121, the hollow tube 122 may be inserted into the ink outlet port 71 of the ink outlet portion 34. Accordingly, ink stored in the ink chamber 36 may flow outward from the ink chamber 36. Ink flowing outward from the ink chamber 36 may flow into the hollow tube 122 via the ink introduction port, along an axial direction of the hollow tube 122, e.g., a direction parallel to the insertion/removal direction 50.

Referring to FIG. 4, an optical sensor 114 may be disposed at the rear interior surface 102 of the case 101 above the connecting portion 103 in the direction of gravity. The optical sensor 114 may comprise a light-emitting element, e.g., a light-emitting diode (LED), and a light-receiving element, e.g., a phototransistor. Each of the light-emitting element and the light-receiving element may be surrounded by a housing. The external shape of the optical sensor 114 formed by the housing may be a horseshoe shape, or U-shaped, or the like. The light-emitting element and the light-receiving element may be disposed to face each other in the housing with a predetermined distance therebetween in the horizontal direction, perpendicular to the insertion/removal direction 50, e.g., width direction 51. The light-emitting element may be configured to emit light through the housing in one direction, e.g., a horizontal direction perpendicular to the insertion/removal direction 50, e.g., width direction 51. The light-receiving element may be configured to receive the light emitted from the light-emitting element toward the housing in the one direction. The residual ink indicator 33 of the ink cartridge 30 may enter a space between the light-emitting element and the light-receiving element of the optical sensor 114 (i.e., an optical path) when the ink cartridge 30 is installed in the cartridge mounting portion 110. When the residual ink indicator 33 enters the optical path of the optical sensor 114, the optical sensor 114 may detect that the light transmission amount changed due to the residual ink indicator 33.

Referring to FIG. 4, another optical sensor 115 may be disposed at the rear interior surface 102 of the case 101 above the optical sensor 114 in the direction of gravity. The optical sensor 115 may have a structure similar to that of the optical sensor 114. Thus, the detailed description of such a structure of the optical sensor 115 is omitted herein. The light attenuating portion 90 of the ink cartridge 30 may enter a space between the light-emitting element and the light-receiving element of the optical sensor 115 (i.e., an optical path) when the ink cartridge 30 is installed in the cartridge mounting portion 110. When the light attenuating portion 90 enters the optical path of the optical sensor 115, the optical sensor 115 may detect the light blocked or attenuated by the light attenuating portion 90.

Referring to FIG. 4, the case 101 may comprise, e.g., three, contact members 106 disposed on the upper interior surface 104 of the case 101 at a position between the rear interior surface 102 and the opening 112. The contact members 106 may be separated from each other in the width direction 51, perpendicular to the insertion/removal direction 50, to correspond to the HOT electrode 75, the GND electrode 76, and the signal electrode 77 of the electronic circuit board 74 of the ink cartridge 30.

Each contact member 106 may have a shape of an inverted triangle or V-shape, protruding downward from the upper interior surface 104. Each contact member 106 may comprise a belt-like member having electrical conductivity and elasticity. Each contact member 106 may be bent in a triangular shape so as to protrude downward from the upper interior surface 104 in the height direction 52. More specifically, each contact member 106 may comprise a first portion extending linearly downward and toward the opening 112 from the upper interior surface 104 and a second portion extending linearly upward and toward the opening 112 from an end of the first portion. A gap may be provided between an end of the second portion and the upper interior surface 104. A ridge 108 of the triangular shape (e.g., an apex of the inverted triangle) may be disposed at the intersection of the first portion and the second portion. An upper portion of the second portion of the contact member 106 may be disposed closer to the opening 112 than a lower portion of the second portion. The second portion of the contact member 106 may comprise a contact surface 107 that may face toward the opening 112 and may be inclined with respect to the height direction 52. The contact surface 107 of each of the three contact members 106 may be configured to contact the respective HOT electrode 75, the GND electrode 76, and the signal electrode 77. The contact member 106 may be configured such that its inverted triangular portion may elastically deform to move the second portion closer to the upper interior surface 104 and to reduce the angle formed between the first portion and the second portion (e.g., the angle of the apex of the inverted triangle). When an external force is not applied to the contact members 106, the contact members 106 may protrude downward from the upper interior surface 104 and the ridges 108 may be positioned below the lower end portions of the ridge 69 in the height direction 52 in the respective HOT electrode 75, the GND electrode 76, and the signal electrode 77 at a movement path of the respective HOT electrode 75, the GND electrode 76, and the signal electrode 77 when the ink cartridge 30 is installed in the cartridge mounting portion 110. The first portion and the second portion of the contact member 106 may not linearly extend. In another embodiment, the contact member 106 may extend, for example, in a curve. The shape of the contact member 106 may not be limited to the inverted triangular shape. In another embodiment, the shape of the contact member 106 may be any shape, as long as the contact member 106 has a portion configured to contact the respective HOT electrode 75, the GND electrode 76, and the signal electrode 77 of the ink cartridge 30.

Each contact member 106 may be electrically connected to a controller via an electric circuit. The controller may comprise, for example, a central-processing unit ("CPU"), a read-only memory ("ROM"), and a random-access memory ("RAM") and may be configured as a control device of the printer 10. The contact member 106 may establish electrical connection with the HOT electrode 75, to apply a voltage Vc to the HOT electrode 75. Another contact member 106 may establish electrical connection with the GND electrode 76, to allow the GND electrode 76 to establish a ground. The contact members 106 may establish electrical connection with the HOT electrode 75 and the GND electrode 76, to supply power to the IC. The other contact member 106 may establish electrical connection with the signal electrode 77, to access data stored in the IC. A signal that is output to the electric circuit via the contact members 106 may be input to the controller.

Referring to FIG. 5, while the ink cartridge 30 is being installed in the cartridge mounting portion 110, portions of the ridge 69 at the HOT electrode 75, the GND electrode 76, and the signal electrode 77 of the electronic circuit board 74 may contact the corresponding contact surface 107 of the contact members 106. As the ink cartridge 30 is further inserted into the cartridge mounting portion 110 in the insertion direction 56, each contact surface 107 of the contact members 106 may slide relative to the ridge 69 while contacting the ridge 69. Accordingly, the contact members 106 may elastically deform. More specifically, the contact member 106 may elastically deform such that the second portion of the contact member 106 may approach the upper interior surface 104 and the angle between the first portion and the second portion (e.g., the angle of the apex of the inverted triangle) may be reduced.

Figure 6:
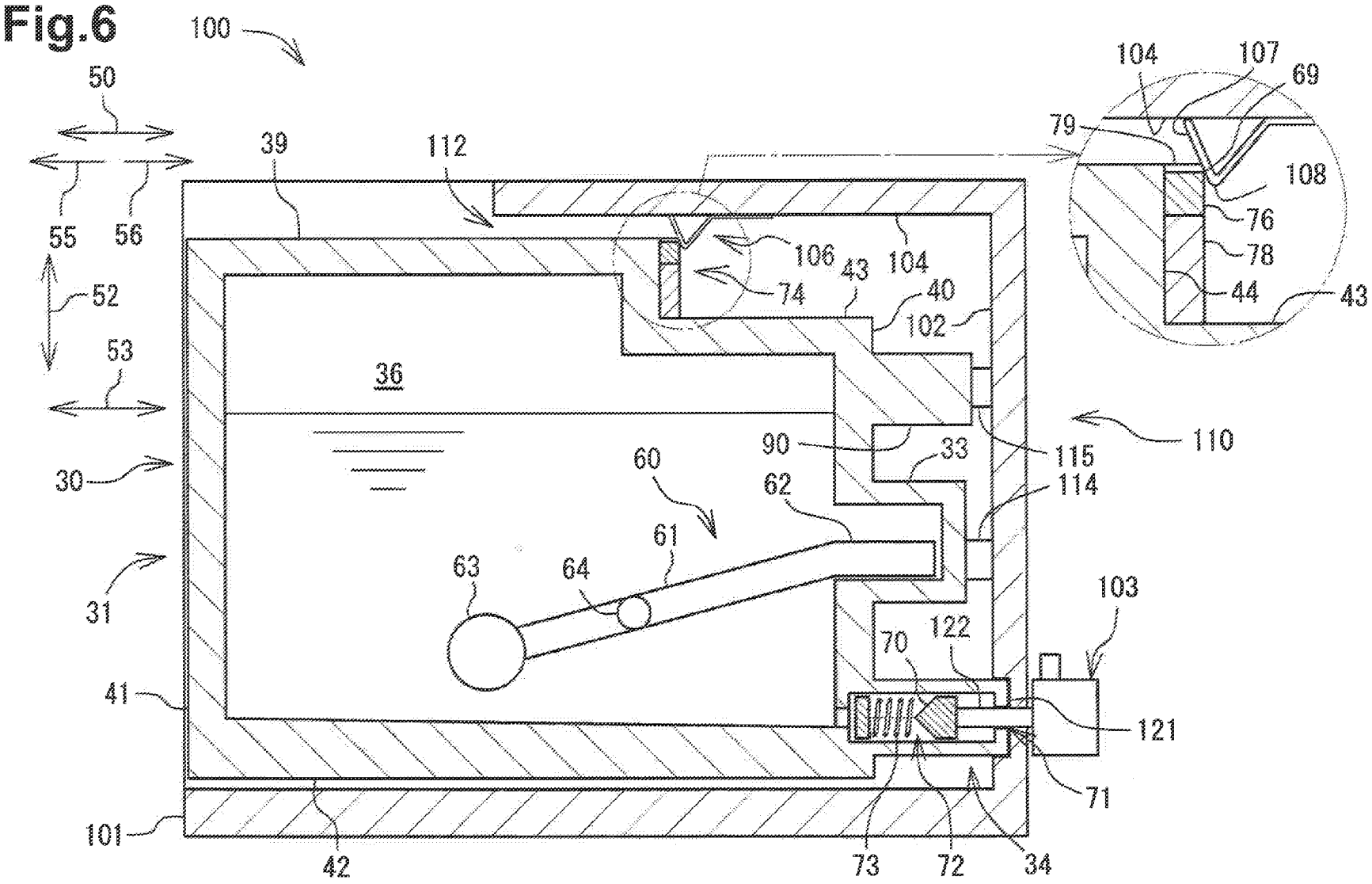
FIG. 6 is a cross-sectional view of the ink cartridge installed in the cartridge mounting portion according to an embodiment of the present invention.

Referring to FIG. 6, when the ink cartridge 30 is further inserted in the insertion direction 56 and installed in position on the cartridge mounting portion 110, portions of the ridge 69 at the HOT electrode 75, the GND electrode 76, and the signal electrode 77 may make close contact with the contact surfaces 107 of the contact members 106 due to an elastic restoring force of the contact members 106. More specifically, an elastic restoring force may be applied to the contact member 106 such that an end of the second portion of the contact member 106 may move away from the upper interior surface 104, and the angle between the first portion and the second portion (e.g., the angle of the apex of the inverted triangle) may increase. Thus, the contact surface 107 of the contact member 106 may make reliable electrical connection to portions of the ridge 69 at the HOT electrode 75, the GND electrode 76, and the signal electrode 77.

Data read from the IC of the electronic circuit board 74 via the contact members 106 may be used to determine the type of the ink cartridge 30 (e.g., ink color, capacity, etc.) with a known method. A detailed description of determining the type of the ink cartridge 30 using such a known method is omitted herein.

The residual ink indicator 33 may reach a detecting position of the optical sensor 114 in which the light-emitting element and the light-receiving element may face each other and the light-receiving element may detect or receive the light. Thus, the optical sensor 114 may detect the indicator portion 62 of the sensor arm 60. The light attenuating portion 90 may reach a detecting position of the optical sensor 115. Thus, the optical sensor 115 may detect the light attenuating portion 90.

Referring to FIG. 5, the ink outlet portion 34 may contact the holding portion 121, and the hollow tube 122 may enter the ink outlet port 71 of the ink outlet portion 34. As the main body 31 is further moved in the insertion direction 56 with the hollow tube 122 contacting the valve 70 through the ink outlet port 71, the hollow tube 122 may push the valve 70 to move away from the ink outlet port 71 against the urging force of the coil spring 73, as depicted in FIG. 6. As the ink outlet portion 34 is inserted into the holding portion 121, and the hollow tube 122 is inserted into the ink outlet port 71, the main body 31 of the ink cartridge 30 may be placed in a predetermined portion of the case 101. Ink may flow from the ink chamber 36 to the hollow tube 122 via the ink introduction port.

When the ink cartridge 30 is installed on the cartridge mounting portion 110, the urging force of the coil spring 73 of the ink cartridge 30 may be transmitted to the hollow tube 122 of the cartridge mounting portion 110. Accordingly, the coil spring 73 may apply to the ink cartridge 30 such a force that may urge the ink cartridge 30 in the removal direction 55. To hold the ink cartridge 30 in position in the cartridge mounting portion 110, a portion of the cartridge mounting portion 110 may be configured to engage with the ink cartridge 30 when the ink cartridge 30 is installed on the cartridge mounting portion 110. For example, a lever configured to engage with the ink cartridge 30 may be disposed at an upper portion of the cartridge mounting portion 110. The lever may engage with the ink cartridge 30 to hold the ink cartridge 30 in position in the cartridge mounting portion 110.

When ink in the ink chamber 36 of the ink cartridge 30 is consumed, the ink cartridge 30 with depleted ink may be moved in the removal direction 55 to remove the ink cartridge 30 from the cartridge mounting portion 110. A new ink cartridge 30 may be installed in the cartridge mounting portion 110.

As described above, the residual ink indicator 33 may comprise the sensor arm 60. In another embodiment, the residual ink indicator 33 may not comprise the sensor arm 60. The light-emitting element and the light-receiving element of the optical sensor 114 may oppose in a horizontal direction perpendicular to the insertion/removal direction 50, e.g., the width direction 51. The light emitted from the light-emitting element may pass in the horizontal direction perpendicular to the insertion/removal direction 50 and be received by the light-receiving element. When there is ink in the residual ink indicator 33, the residual ink indicator 33 may block or attenuate the light emitted from the light-emitting element. When there is no ink in the residual ink indicator 33, the residual ink indicator 33 may allow a predetermined amount or more of the light emitted from the light-emitting element to pass. In another embodiment, the residual ink indicator 33 may comprise a flexible film. When there is ink in the residual ink indicator 33, the film may be expanded. As the film contacts a pivot lever, the lever may be placed at a position to block the light. When there is no ink in the residual ink indicator 33, the film may be contracted. The lever may pivotally move up or down so as to be located at a position where the light is not blocked. In another embodiment, the light emitted from the light-emitting element may be reflected on or in the residual ink indicator 33 so as not to reach the light-receiving element when there is ink in the residual ink indicator 33, and may be reflected on or in the residual ink indicator 33 so as to be received by the light-receiving element when there is no ink in the residual ink indicator 33. In another embodiment, the sensor arm 60 may not be used with the optical sensor 114. For example, the sensor arm 60 may be configured to be recognized outside the ink cartridge 30 via the residual ink indicator 33 comprising a translucent material. A residual ink amount in the ink cartridge 30 may be determined by detecting the sensor arm 60 configured to move in accordance with a residual ink amount in the ink cartridge 30.

As described above, the HOT electrode 75, the GND electrode 76, and the signal electrode 77 may be disposed at the ridge 69, which may be a boundary between the front surface 78 and the upper surface 79 of the electronic circuit board 74 of the ink cartridge 30. In association with the insertion of the ink cartridge 30 into the cartridge mounting portion 110, the HOT electrode 75, the GND electrode 76, and the signal electrode 77 may slide relative to the respective contact surface 107 of the contact members 106. The surfaces of the HOT electrode 75, the GND electrode 76, and the signal electrode 77 may be rubbed by the respective contact surfaces 107 of the contact members 106, so that for example, an oxide film or dusts may be removed from the HOT electrode 75, the GND electrode 76, and the signal electrode 77. Portions of the ridge 69 that may be in a condition suitable for electrical connection may contact the respective contact members 106. Thus, the condition of electrical connection between portions of the ridge 69 and the respective contact members 106 may be improved.

Surfaces of the HOT electrode 75, the GND electrode 76, and the signal electrode 77 may be inwardly curved along the ridge 69. A portion of each of the contact surfaces 107 of the respective contact members 106 that may slide relative to the ridge 69, in association with the insertion of the ink cartridge 30 into the cartridge mounting portion 110, may be positioned over a most inwardly curved portion of the HOT electrode 75, the GND electrode 76, and the signal electrode 77, respectively.

As described above, the electronic circuit board 74 may be disposed at the front wall 44 of the main body 31 of the ink cartridge 30. In another embodiment, referring to FIG. 7, an ink cartridge 130 may comprise the electronic circuit board 74 disposed at the upper wall 39, which is extended between the front wall and the rear wall of the main body 31. In such an embodiment, a connecting surface of the electronic circuit board 74 having a thin plate shape may correspond to the front surface or the third surface. While the ink cartridge 130 is installed in the cartridge mounting portion 110, portions of the ridge 69 at the respective HOT electrode 75, the GND electrode 76, and the signal electrode 77 of the electronic circuit board 74 may contact the respective contact surfaces 107 of the contact members 106. An exterior surface of the upper wall 39 of the ink cartridge 130 may correspond to a fifth surface. The ink outlet portion 34 may be positioned at a lower portion of the front wall 40 of the main body 31. Among the side walls 37 and 38, the upper wall 39, and the bottom wall 41 of the main body 31 adjoining the front wall 40, the upper wall 39 may be a wall of the main body 31 a greatest distance away from the ink outlet portion 34. Therefore, the possibility that ink adheres to the electronic circuit board 74 may be reduced.

As the ink cartridge 130 is further inserted into the cartridge mounting portion 110 in the insertion direction 56, the contact surfaces 107 of the contact members 106 may slide relative to the ridge 69 while contacting the ridge 69. Accordingly, the contact members 106 may elastically deform upward.

When the ink cartridge 130 is installed in position on the cartridge mounting portion 110, the contact surfaces 107 of the contact members 106 may contact the ridge 69 to electrically connect to the HOT electrode 75, the GND electrode 76, and the signal electrode 77, respectively. While the ink cartridge 130 is being installed in the cartridge mounting portion 110, the ridge 69 of the electronic circuit board 74 may slide with the contact members 106, so that, for example, an oxide film or dust at the ridge 69 may be removed. The contact members 106 may contact the ridge 69, the surface of which may be in a condition suitable for electrical connection with the oxide film or dust thereon removed. Thus, the condition of electrical connection between the ridge 69 and the contact members 106 may be improved.

Figure 7:
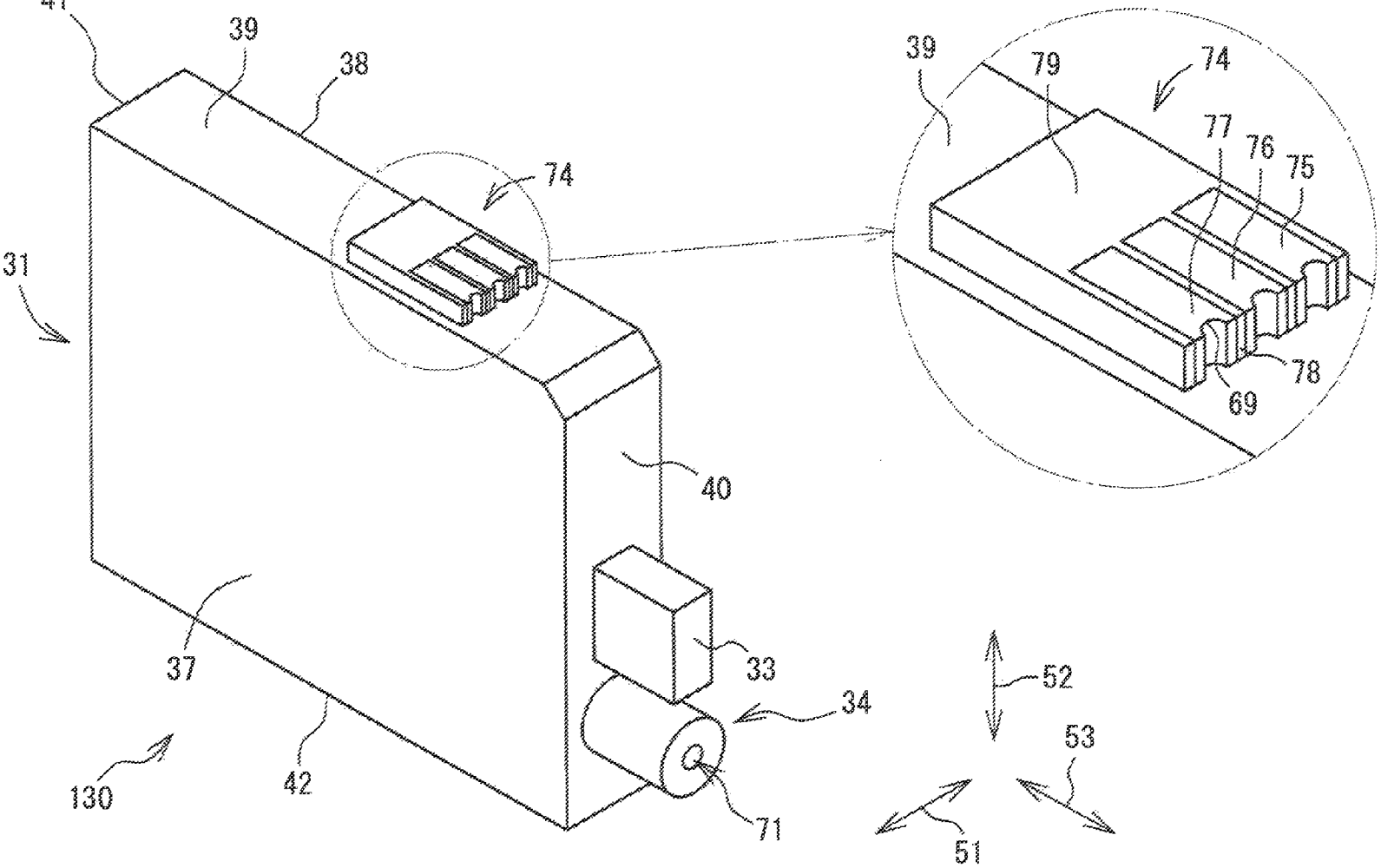
FIG. 7 is a perspective view of an ink cartridge according to another embodiment of the present invention.

In another embodiment, after each contact surface 107 of the contact members 106 slides in contact with a portion of the ridge 69 at the HOT electrode 75, the GND electrode 76, and the signal electrode 77, respectively, each contact member 106 may be raised over the electronic circuit board 74. Thus, an upper surface of the electronic circuit board 74, e.g., the surface of the HOT electrode 75, the GND electrode 76, and the signal electrode 77 facing upward, may contact the respective ridge 108 of the contact member 106 to electrically connect thereto. As depicted in FIG. 7, the ink cartridge 130 may not comprise the light attenuating portion 90.

In an embodiment, the HOT electrode 75, the GND electrode 76, and the signal electrode 77 may be disposed at the ridges 69, which may be a boundary between the front surface 78 and the upper surface 79 of the electronic circuit board 74. However, the electrodes 75-77 may not be disposed across the front surface 78 and the upper surface 79 of the electronic circuit board 74. For example, referring to FIG. 8A, an ink cartridge 230 may comprise an electronic circuit board 81 comprising elastically deformable resin, which may be disposed on the front the front wall 40 of the main body 31, such that a portion of the electronic circuit board 81 may protrude upwardly from the front wall 40. A HOT electrode 82, a GND electrode 83, and a signal electrode 84 may be disposed at a portion corresponding to the corner between the upper wall 39 and the front wall 40 of the main body 31.

When the ink cartridge 230 is not installed in the cartridge mounting portion 110, the electronic circuit board 81 may maintain a thin plate shape extending along the front wall 40 in the height direction 52. The HOT electrode 82, the GND electrode 83, and the signal electrode 84 may face the insertion direction 56 along the front wall 40.

Figure 8B:
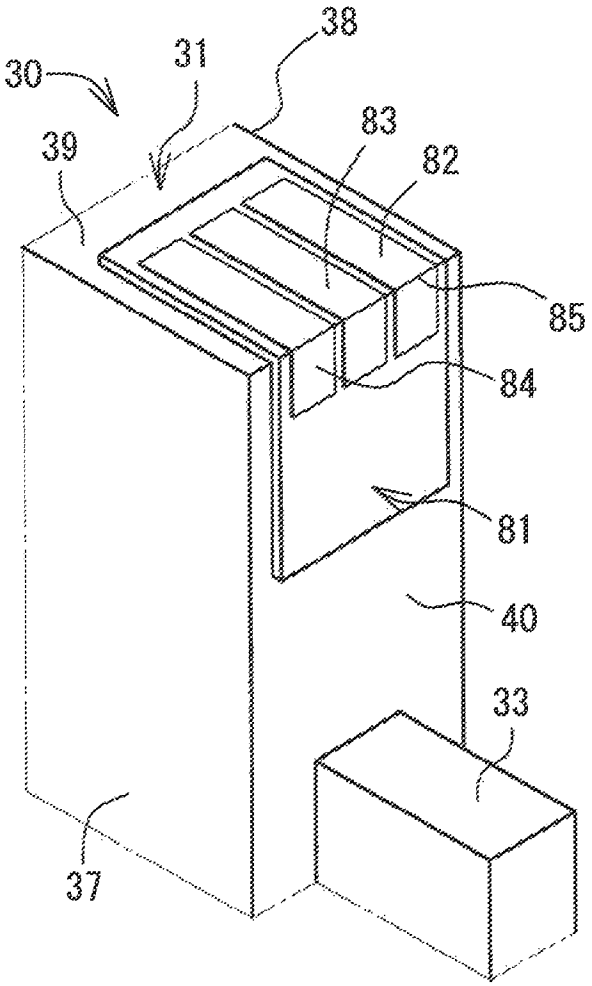
FIGS. 8A and 8B are partial perspective views of an ink cartridge according to still another embodiment of the present invention.
Figure 8A:
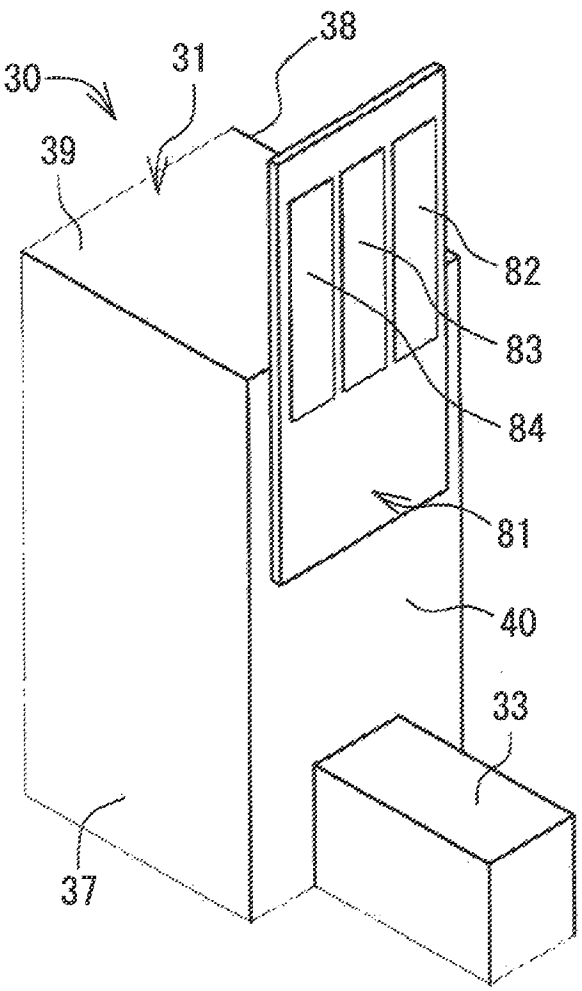

While the ink cartridge 30 is being installed in the cartridge mounting portion 110, a portion of the electronic circuit board 81 extending upward from the upper wall 39 of the main body 31 may contact the contact members 106 (e.g., at the upper interior surface 104). Accordingly, as depicted in FIG. 8B, the electronic circuit board 81 may bend along the corner between the upper wall 39 and the front wall 40 of the main body 31, so that a ridge 85 may be formed at the corner between the upper wall 39 and the front wall 40. For example, the electronic circuit board may be configured to bend between the first portion and the second portion, such that such that the second portion faces a third direction away from the ink outlet portion that intersects a plane that is parallel to the first direction. The electrical circuit board 81 may be made of resin. The contact surfaces 107 of the contact members 106 may slide relative to portions of the ridge 85 at the respective HOT electrode 82, the GND electrode 83, and the signal electrode 84. When the ink cartridge 230 is installed in position on the cartridge mounting portion 110, each of the contact surfaces 107 or the ridges 108 of the respective contact members 106 may contact a portion of a surface of the HOT electrode 82, the GND electrode 83, and the signal electrode 84 extending along the upper wall 39 of the main body 31, to electrically connect to the respective electrodes 82-84.

While the invention has been described in connection with various exemplary structures and illustrative configurations, it will be understood by those skilled in the art that other variations and modifications of the structures, configurations, and embodiments disclosed above may be made without departing from the scope of the invention. For example, this application comprises each and every possible combination of the various elements and features disclosed and incorporated by reference herein, and the particular elements and features presented in the claims and disclosed and incorporated by reference above may be combined with each other in each and every possible way within the scope of the application, such that the application should be recognized as also directed to other embodiments comprising other possible combinations. Other structures, configurations, and embodiments consistent with the scope of the claimed invention will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge, comprising:

a main body comprising a first surface, a second surface and a third surface between the first and second surfaces;

a chamber configured to store ink and disposed between the first surface and the second surface;

an outlet on the first surface of the main body configured to direct the ink from the chamber to an exterior of the main body in a first direction; and an electronic circuit board disposed on the main body, wherein the entire electronic circuit board is positioned between the outlet and the third surface, wherein the electronic circuit board comprises:

a first portion facing a second direction that intersects a first plane that is perpendicular to the first direction;

a second portion facing a third direction away from the ink outlet portion that intersects a second plane that is parallel to the first direction; and a connecting portion between the first portion and the second portion, and an electrical interface disposed on an area of the electronic circuit board including the connecting portion.

2. The ink cartridge of claim 1, wherein:

the first surface includes first and second wall portions that are not on a common plane, the first wall portion being offset from the second wall portion towards the second surface;

the electronic circuit board includes a third portion opposite the first portion mounted on the first wall portion; and the outlet is on the second wall portion.

3. The ink cartridge of claim 2, wherein the first wall portion of the first surface, the second wall portion of the first surface, the first portion of the electronic circuit board, and the third portion of the electronic circuit board are parallel to one another.

4. The ink cartridge of claim 2, wherein the third surface includes third and fourth wall portions that are not on a common plane, the third wall portion being offset from the fourth wall portion towards the outlet, and wherein the third wall portion of the third surface extends between the first and second wall portions of the first surface, and the fourth wall portion of the third surface extends between the first wall portion of the first surface and the second surface.

5. The ink cartridge of claim 4, wherein the third and fourth wall portions of the third surface are parallel to one another.

6. The ink cartridge of claim 2, further comprising a residual ink indicator on the second wall portion of the first surface between the electronic circuit board and the outlet.

7. The ink cartridge of claim 6, wherein the residual ink indicator includes an open end in fluid communication with the chamber, and an indicator received therein configured to move in response to an amount of ink in the chamber.

8. The ink cartridge of claim 2, further comprising a light attenuator extending from the second wall portion of the first surface between the electronic circuit board and the outlet.

9. The ink cartridge of claim 1, wherein the first portion of the electronic circuit board is planar and defines a first area, and the second portion the electronic circuit board is planar and defines a second area that is smaller than the first area.

10. An ink cartridge, comprising:

a main body comprising a front wall, a rear wall and an upper wall between the front and rear walls;

an outlet on the front wall; and an electronic circuit board disposed on the main body, wherein the electronic circuit board comprises:

a front surface;

an upper end surface that defines a thickness of the electronic circuit board;

an electrical interface on the front surface and the upper end surface, and the upper end surface of electronic circuit board is smaller than the front surface.

11. The ink cartridge of claim 10, wherein:

the outlet defines an axis extending in a first direction;

the front surface of the electronic circuit board faces a second direction that intersects a first plane that is perpendicular to the first direction;

the upper end surface of the electronic circuit board faces a third direction away from the outlet that intersects a second plane that is parallel to the first direction;

the electronic circuit board includes a connecting portion where the front surface of the electronic circuit board abuts the upper end surface of the electronic circuit board; and the electrical interface is disposed on an area of the electronic circuit board including the connecting portion.

12. The ink cartridge of claim 10, wherein:

the front wall includes first and second front wall portions that are not on a common plane;

the electronic circuit board is mounted on the first front wall portion; and the outlet is on the second front wall portion.

13. The ink cartridge of claim 12, wherein the first front wall portion is offset from the second front wall portion towards the rear wall.

14. The ink cartridge of claim 13, wherein the first and second front wall portions and the front surface of the electronic circuit board are parallel to one another.

15. The ink cartridge of claim 10, wherein the upper wall includes first and second upper wall portions that are not on a common plane, the first upper wall portion being offset from the second upper wall portion towards the outlet, and wherein the electronic circuit board is mounted between the first and second upper wall portions.

16. The ink cartridge of claim 15, wherein the first and second upper wall portions are parallel to one another.

17. The ink cartridge of claim 10, wherein the entire electronic circuit board is positioned between the outlet and the rear wall.

18. An ink cartridge, comprising:

a main body comprising a front wall facing a particular direction, and including a first front wall portion and a second front wall portion, a rear wall and an upper wall between the front and rear walls, and including a first upper wall portion and a second upper wall portion disposed further than the first upper wall portion in an upper direction and disposed further than the first upper wall portion towards the rear wall;

an outlet through the second front wall portion; and a circuit board mounted on the first front wall portion, wherein the first front wall portion is disposed between the first upper wall portion and the second upper wall portion in the upper direction, and wherein the electronic circuit board is provided with an electrical interface disposed along an edge of the electrical circuit board.

19. The ink cartridge according to claim 18, wherein the outlet is disposed further than the first front wall portion in the particular direction.

20. The ink cartridge according to claim 18, wherein the electronic circuit board further comprises a front surface, and an upper end surface that defines a thickness of the electronic circuit board, and wherein the edge of the electrical circuit board is formed with the front surface, and the upper end surface.

* * * * *